United States Patent [19]

Mainprice

[11] 4,257,635

[45] Mar. 24, 1981

[54] SCOOP DEVICE

[76] Inventor: Peggy L. Mainprice, 4210 NE. 85th St., Seattle, Wash. 98115

[21] Appl. No.: 1,530

[22] Filed: Jan. 8, 1979

[51] Int. Cl.[3] ..... A47F 13/06

[52] U.S. Cl. ..... 294/1 BA

[58] Field of Search ..... 294/19 R, 1 R, 24, 51, 294/52, 57, 55, 1 BA; 15/257.1, 257.4, 257.7, 257.8; 56/400.06, 400.11; 248/95, 99, 101

[56] References Cited

U.S. PATENT DOCUMENTS

| | | | |
|---|---|---|---|
| 2,763,506 | 9/1956 | Denker et al. | 294/5 |
| 3,810,670 | 5/1974 | Turi | 294/1 BA |
| 4,012,067 | 3/1977 | Travis | 294/1 BA |
| 4,103,953 | 8/1978 | Lachance | 294/1 BA |
| 4,121,866 | 10/1978 | Schall et al. | 294/1 BA |

*Primary Examiner*—James B. Marbert

*Attorney, Agent, or Firm*—Seed, Burry, Vernon & Baynham

[57] ABSTRACT

A device for removing animal droppings in which the handle is collapsible and a water soluble, disposable bag is attached to a flexible rim and attached by an adhesive. The rim can bow and flattens when pressed against the ground. The handle has non-circular sections to avoid twisting when in use.

13 Claims, 8 Drawing Figures

FIG. 3
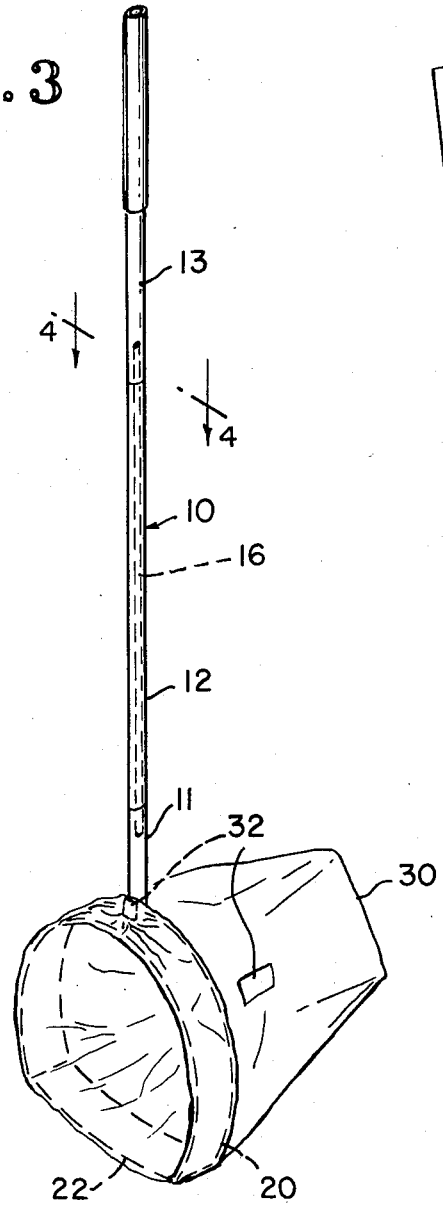
FIG. 1
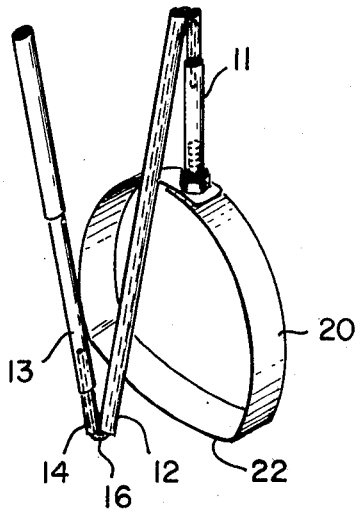
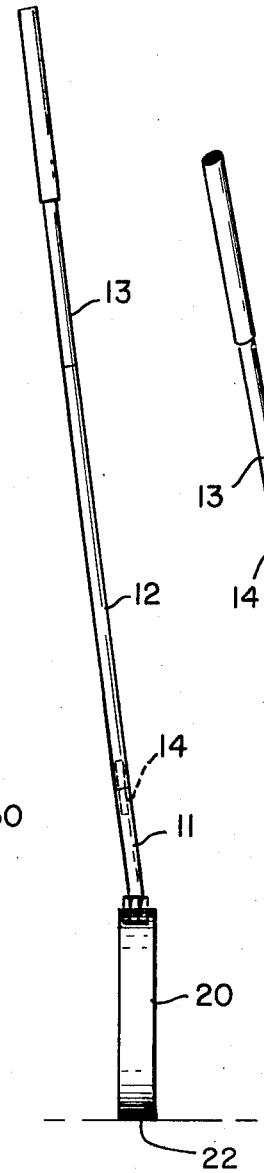
FIG. 2
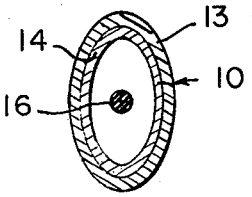
FIG. 4

SCOOP DEVICE

BACKGROUND OF THE INVENTION

1. Field of the Invention

This invention relates to refuse pickup devices and, more particularly, to a hand-held scoop device having a disposable bag for collecting animal waste.

2. Description of the Prior Art

U.S. Pat. No. 4,021,994 illustrates a handle mounted rim for holding a disposable plastic bag. This scoop device disclosed in the patent is a readily usable sanitary scoop device for removing dog waste from lawns, sidewalks, parking strips, etc.

SUMMARY OF THE INVENTION

It is an object of this invention to provide an improved scoop device for removing dog wastes.

It is another object of this invention to provide a scoop device which employs a disposable water soluble, plastic bag and which is easier to operate and carry and less expensive to manufacture than my earlier scoop device.

Basically, these objects are obtained by mounting on the end of a collapsible handle a wide flexible rim and attaching a water soluble, disposable bag to the rim preferably by elastically stretching a reverse folded lip over the wide rim. In a second form an adhesive strip assists in attaching the handle and the bag. The handle is provided with means to resist rotation of the sections of the handle when subjected to forces on the rim. Preferably the disposable bag can be folded to seal the bag when full but in a second form the bag is provided with second sealing means to close the bag when filled.

BRIEF DESCRIPTION OF THE FIGURES OF THE DRAWING

FIG. 1 is an isometric of a handle and rim of an embodiment of my scoop device shown with the handle in a collapse condition.

FIG. 2 is a side elevation of the scoop device shown in FIG. 1 with the handle erected.

FIG. 3 is an isometric of the scoop device shown in FIG. 1 with a bag attached to the rim.

FIG. 4 is a section taken along the line 4—4 of FIG. 3.

DETAILED DESCRIPTION OF THE PREFERRED EMBODIMENTS

Figure 5:
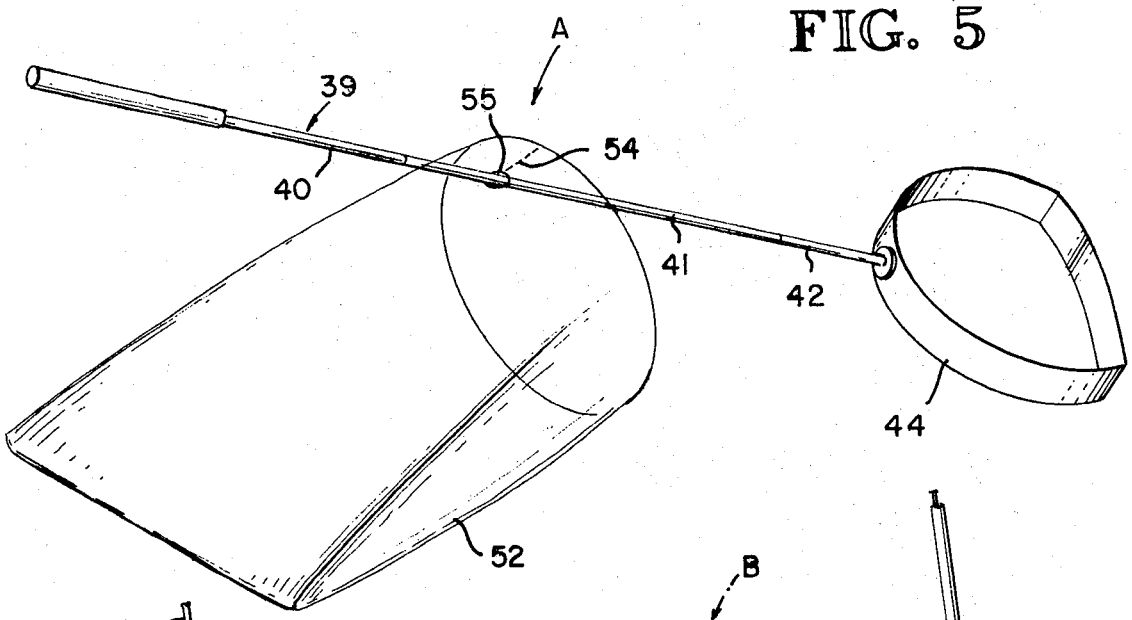
FIG. 5 is an isometric of a preferred embodiment of my scoop device.

As best shown in FIG. 3, one form of the scoop device includes a handle 10 having multiple sections 11, 12 and 13. As shown in FIG. 4, these sections are oval in cross section preferably by being extruded in an oval form. In the alternative, of course, the sections can be cylindrical with the ends of the sections formed into an oval configuration. Preferably, the sections are joined by a tight fitting plug 14 and an elastic shock cord holds the sections together when folded as shown in FIG. 1. The purpose of the oval cross section at the juncture is to prevent the handle sections from twisting relative to one another.

Joined to the lower end of the section 11 is a spring steel flexible rim 20. The rim has a slightly bowed lowered surface 22 which, when pressed to the ground will flatten bowing out the side surfaces of the rim bringing the bottom surface of the rim 22 in better conformance with the soil or paved surface. This makes lifting the dog wastes much easier. Attached to the rim is a disposable plastic bag 30, preferably having a sealing strip 32 which after the end of the bag is folded tightly around the rim 20 is sealed to the handle 11. In addition, a closure strip 32 is provided outside the bag so that as the bag becomes filled the bag can be removed and sealed merely by removing the guard strip from the adhesive strip 32 and squeezing the bag together.

As is readily apparent, the scoop device is employed by interconnecting the handle sections and attaching a bag over the rim. Then the rim can be slid along the ground or pavement beneath the dog waste and with a flick of the wrist much as a golf stroke the bag is flicked beneath the dog waste and deposited in the bag. It is desirable that the handle sections be relatively flexible as in a golf club shaft to enable the snapping movement of the rim since the quick acceleration force helps to slide the rim beneath the dog waste.

In a preferred form of the scoop device as shown in FIGS. 5–8, a handle 39 has sections 40, 41 and 42, connected by an elastic cord 43. Section 42 is connected to a spring rim 44 by a rivet having a bent body 46 pressed into the section 42 and bonded therein and a head 45 holding the rim onto the handle. In both embodiments the rim 44 is of a substantial width to cause the elasticity of the bag to firmly grip and be supported by the rim. The sections 40, 41 and 42 are interconnected together to resist twisting by rods 50 that are crimped out-of-round as at **50*a*** so that a tight press fit is required to force one handle section against an adjacent handle section.

Figure 6:
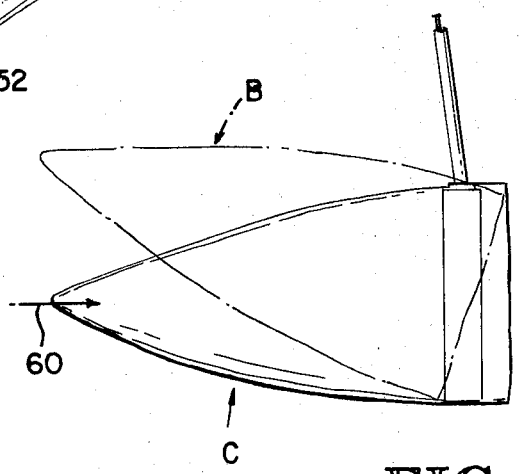
FIG. 6 is a fragmentary operational view illustrating two steps in attaching a bag in the preferred embodiment of FIG. 5.
Figure 7:
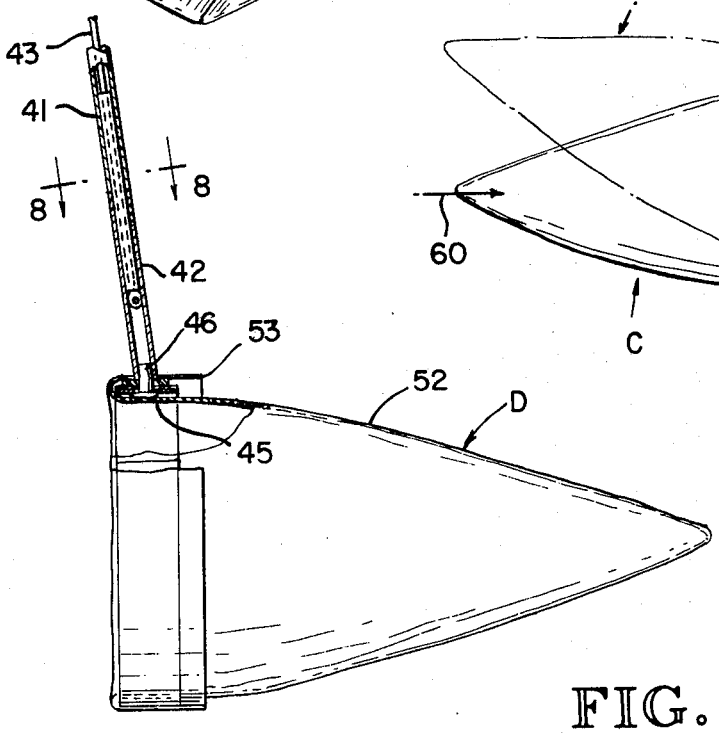
FIG. 7 is a fragmentary section showing an attached bag and the handle-rim attachment technique in the preferred embodiment of FIG. 5.
Figure 8:
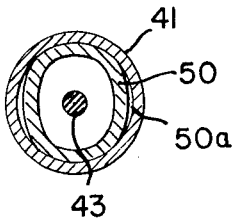
FIG. 8 is a section along line 8—8 of FIG. 7.

In this preferred embodiment a water soluble bag 52 has a lip 53, which is reverse folded over the rim as will be described. The bag has a perforated line 54 terminating in a hole 55 which is slid over the handle as in FIG. 3 as position A. The bag is then slid into position B (FIG. 6). In position C the bag is stretched around the rim and the closed end is pushed through the rim 44 as shown by arrow 60 until it reaches the position D shown in FIG. 7. In this position a lip 53 is formed which tightly engages the outer surface of the rim 44. To remove the bag the perforation is torn and the lip removed from the rim. Then the bag is folded to seal the opening.

What I claim is:

1. A scoop device adapted for collecting animal feces and the like, comprising:

a collapsible, flexible handle;

a continuous rim attached to the lower end of the handle, said rim having a flexible, resilient wide bottom portion which is outwardly bowed in a direction perpendicular to the width of the wide bottom portion, and which, when pressed against a surface, will flex inwardly perpendicular to the width of the bottom portion to generally conform to the surface; and a disposable bag adapted to be fitted over said rim.

2. The scoop device of claim 1, said rim further including spaced, flexible, resilient side portions adjoining said bottom portion, the flexibility of said side portions enhancing the flexible conforming of bottom portion to the surface against which it is pressed.

3. The scoop device of claim 1, said rim being attached to said handle at an obtuse angle to the handle whereby with the handle leaning forwardly the bottom portion of the rim will lie flat on the surface against which it is pressed.

4. The scoop device of claim 3, said rim being attached to said flexible handle by a rivet having a body and a head, the handle having a hollow lower end, the body of said rivet being bent at said obtuse angle and being inserted within and secured to said handle.

5. The scoop device of claim 1, said handle including multiple hollow sections having ends interfitted into each other and a tensioned elastic cord passing through all said sections for aligning the sections into a straight line for assembling the handle.

6. The scoop device of claim 1, said bag having a closed end and an open end, a hole spaced from said open end and adapted to fit over said handle for holding the bag on the handle and a perforated tear line between the open end and said hole.

7. A scoop device adapted for collecting animal feces and the like, comprising:

a collapsible, flexible handle;

a rim attached to said handle;

a disposable bag adapted to be fitted over said rim, said handle including a plurality of hollow tubular sections having ends which interfit into one another, and an elastic cord passing through all of said sections and tensioned for pulling all of said sections into straight alignment with one another for assembling the handle.

8. A scoop device, comprising, in combination:

a collapsible handle;

a flexible rim attached to the lower end of the handle, the sections of the handle being interconnected against rotation relative to one another;

a disposable bag adapted to be fastened around the rim, said rim being in a plane which is at an obtuse angle to the handle for placing the plane of the rim generally perpendicular to the ground, said handle sections being relatively flexible, and wherein said rim is flexible and resilient, having bowed sides and a bowed, flexible, resilient bottom surface which is deformable by downward pressure against the surface to flatten the bottom surface and thereby facilitate sliding of the surface beneath the feces.

9. The combination according to claim 8, further including a disposable bag secured to said rim by having its periphery folded over the rim and secured to the handle by an adhesive strip, and means for sealing the bag after use.

10. The combination according to claim 1 or 8, said bag having a reversed folded lip surrounding the bag opening, said rim having inner and outer surfaces each of substantial width, said lip stretched over and engaging the outer surface of the rim, the bag adjacent the lip engaging the inner surface of the rim, whereby the elasticity of the bag and lip retains the bag on the rim.

11. A scoop device, comprising, in combination:

a collapsible handle;

a flexible rim attached to the lower end of the handle, the sections of the handle being interconnected against rotation relative to one another;

a disposable bag adapted to be fastened around the rim, said rim being in a plane which is at an obtuse angle to the handle for placing the plane of the rim generally perpendicular to the ground, said handle sections being relatively flexible, said rim attached to said flexible handle by a rivet having a body and a head, the body of said rivet bent to said obtuse angle and being inserted within and secured to said handle.

12. A scoop device, comprising, in combination:

a collapsible handle;

a flexible rim attached to the lower end of the handle, the sections of the handle being interconnected against rotation relative to one another;

a disposable bag adapted to be fastened around the rim, said rim being in a plane which is at an obtuse angle to the handle for placing the plane of the rim generally perpendicular to the ground, said bag having a closed end and an open end, a hole spaced from said open end and adapted to fit over said handle for holding the bag on the handle, and a perforated tear line between the open end and said hole.

13. A disposable bag suitable for attaching to a handle and an open rim attached to said handle for collecting animal feces or the like in a sanitary manner, comprising:

a disposable bag having a closed end and an open end;

a hole spaced from said open end adapted to fit over a handle and hold the bag on the handle;

the space between the hole and the open end of the bag having a portion when reverse folded that is adapted to fit over the rim and shield the exterior of the bag from the fecal matter; and a perforated tear line extending from the hole to the open end of the bag.

* * * * *